US008185006B2

(12) United States Patent
Takahashi et al.

(10) Patent No.: US 8,185,006 B2
(45) Date of Patent: May 22, 2012

(54) MAGNETIC MATERIAL DETECTING DEVICE

(75) Inventors: Katsumi Takahashi, Moriya (JP); Kazuhisa Koizumi, Abiko (JP)

(73) Assignee: Canon Kabushiki Kaisha (JP)

( * ) Notice: Subject to any disclaimer, the term of this patent is extended or adjusted under 35 U.S.C. 154(b) by 575 days.

(21) Appl. No.: 12/372,349

(22) Filed: Feb. 17, 2009

(65) Prior Publication Data

US 2009/0208234 A1 Aug. 20, 2009

(30) Foreign Application Priority Data

Feb. 18, 2008 (JP) ..... 2008-036035

(51) Int. Cl.
*G03G 15/10* (2006.01)

(52) U.S. Cl. ..... 399/63

(58) Field of Classification Search ..... 399/61–63
See application file for complete search history.

(56) References Cited

U.S. PATENT DOCUMENTS 5,160,968 A * 11/1992 Yamada et al. ..... 399/63

FOREIGN PATENT DOCUMENTS

JP 11-190933 A 7/1999

* cited by examiner

*Primary Examiner* — Hoang Ngo
(74) *Attorney, Agent, or Firm* — Rossi, Kimms & McDowell LLP

(57) ABSTRACT

A magnetic material detecting device, in which a concentration of magnetic material can be correctly detected, even when the magnetic material with unevenness in its density distribution flows. A magnetic field generating device is arranged in a two-component developer composed of magnetic carrier and non-magnetic toner and generates a magnetic field. A signal output device is arranged in the developer and outputs a signal depending on a magnetic permeability of the developer due to the magnetic field generated by the magnetic field generating device. An agitating unit agitates the developer and makes the developer flow between the magnetic field generating device and the signal output device. A detecting unit detects a proportion of the toner in the developer based on a result of multiple times sampling of the signal outputted from the signal output device after the agitating unit starts to operate.

4 Claims, 6 Drawing Sheets

MAGNETIC MATERIAL DETECTING DEVICE

BACKGROUND OF THE INVENTION

1. Field of the Invention

The present invention relates to a magnetic material detecting device adapted to detect a concentration of magnetic material.

2. Description of the Related Art

In a developing device provided in electrophotographic or electrostatic recording image forming apparatus, a two-component developer composed predominantly of toner particles and carrier particles is widely used. In particular, a color image forming apparatus for forming full-color or multicolor images often uses a two-component developing device as the developing device in terms of hue of image or the like.

As is well known, a toner concentration of the two-component developer, i.e. the proportion of weight of toner particles to the total weight of carrier particles and toner particles is a highly important factor in stabilizing image quality.

Toner particles in the developer are consumed on developing process. This causes a change in a toner concentration thereof. Therefore, a developer concentration controller is used to correctly detect the toner concentration of the developer timely, and implement toner replenishment depending on the change, thereby controlling the toner concentration so as to always keep it constant, resulting in retaining image quality.

For detection of a toner concentration, a magnetic material detecting device is widely used, which has no problem about toner stain and can stably detect the concentration.

Apparent magnetic permeability of a developer changes depending on the mixing ratio of magnetic carriers (carrier particles having magnetism) added to non-magnetic toner. The magnetic material detecting device, then, detects the apparent magnetic permeability of the developer, and then detects a toner concentration in the developing device on the basis of the result.

Detection of large apparent magnetic permeability of the developer, for example, can exhibit a state of the increased proportion of the magnetic carrier in the developer occupied within a certain volume, i.e. a state of a low toner concentration. In this case, an image forming apparatus starts toner replenishment.

On the contrary, detection of small apparent magnetic permeability can exhibit a state of the reduced proportion of the magnetic carrier in the developer occupied within the certain volume, i.e. a state of a high toner concentration. In this case, the image forming apparatus stops the toner replenishment.

A device employing a differential transformer is known as the above magnetic material detecting device. For example, a downsized magnetic material detecting device as shown in FIG. 6 has been proposed (for example, Japanese Laid-Open Patent Publication (Kokai) No. 11-190933).

FIG. 6 is a schematic diagram of a magnetic material detecting device according to the prior art.

As shown in FIG. 6, a differential transformer 100 has differentially connected drive coils 104 and 105, and an output coil 106.

An alternating current signal generator 101 supplies an input signal (an alternating current signal) Ein with predetermined electrical characteristics to the drive coils 104 and 105 to drive the drive coils 104 and 105. The input signal Ein from the alternating current signal generator 101 is also supplied to an output coil 106 via a resistance R1 to stabilize an output signal E outputted by the output coil 106.

An amplifier 102 amplifies the output signal E outputted from the output coil 106. An output signal Eout outputted from the amplifier 102 has a phase difference depending on the concentration of magnetic material relative to the input signal Ein.

A phase difference detector 103 detects a phase difference between the input signal Ein supplied to the drive coils 104 and 105 and the output signal Eout outputted from the output coil 106 via the amplifier 102. The adjustment control unit 107 detects the concentration of the magnetic material based on the input signal Ein generated by the alternating current signal generator 101 and the phase difference detected by the phase difference detector 103.

However, the conventional magnetic material detecting device shown in FIG. 6 has a problem that a phase difference signal outputted depending on the concentration of magnetic material easily varies depending on a fluid state of the magnetic material even when the concentration of the magnetic material is constant.

In other words, even when the concentration of the magnetic material is constant, flow of the developer with unevenness (condensation and rarefaction) in density distribution of the magnetic material produces change in a phase difference value detected by the magnetic material detecting device depending on a timing of detecting the phase difference.

This leads to false recognition that the concentration of the magnetic material has changed, regardless of the constant concentration of the magnetic material.

SUMMARY OF THE INVENTION

The present invention provides a magnetic material detecting device being able to correctly detect the concentration of magnetic material even when the magnetic material with unevenness in its density distribution flows.

Accordingly, in the present invention, there is provided a magnetic material detecting device comprising a magnetic field generating device that is arranged in a two-component developer composed of magnetic carrier and non-magnetic toner and generates a magnetic field, a signal output device that is arranged in the two-component developer and outputs a signal depending on a magnetic permeability of the two-component developer due to the magnetic field generated by the magnetic field generating device, an agitating unit that agitates the two-component developer and make the two-component developer flow between the magnetic field generating device and the signal output device, and a detecting unit that detects a proportion of the non-magnetic toner in the two-component developer based on a result of multiple times sampling of the signal outputted from the signal output device after the agitating unit starts to operate.

According to the present invention, the concentration of magnetic material can be detected correctly even when magnetic material with unevenness in its density distribution flows.

The features and advantages of the invention will become more apparent from the following detailed description taken in conjunction with the accompanying drawings.

DETAILED DESCRIPTION OF THE PREFERRED EMBODIMENTS

The present invention will now be described in detail with reference to the accompanying drawings showing preferred embodiments thereof.

Figure 1:
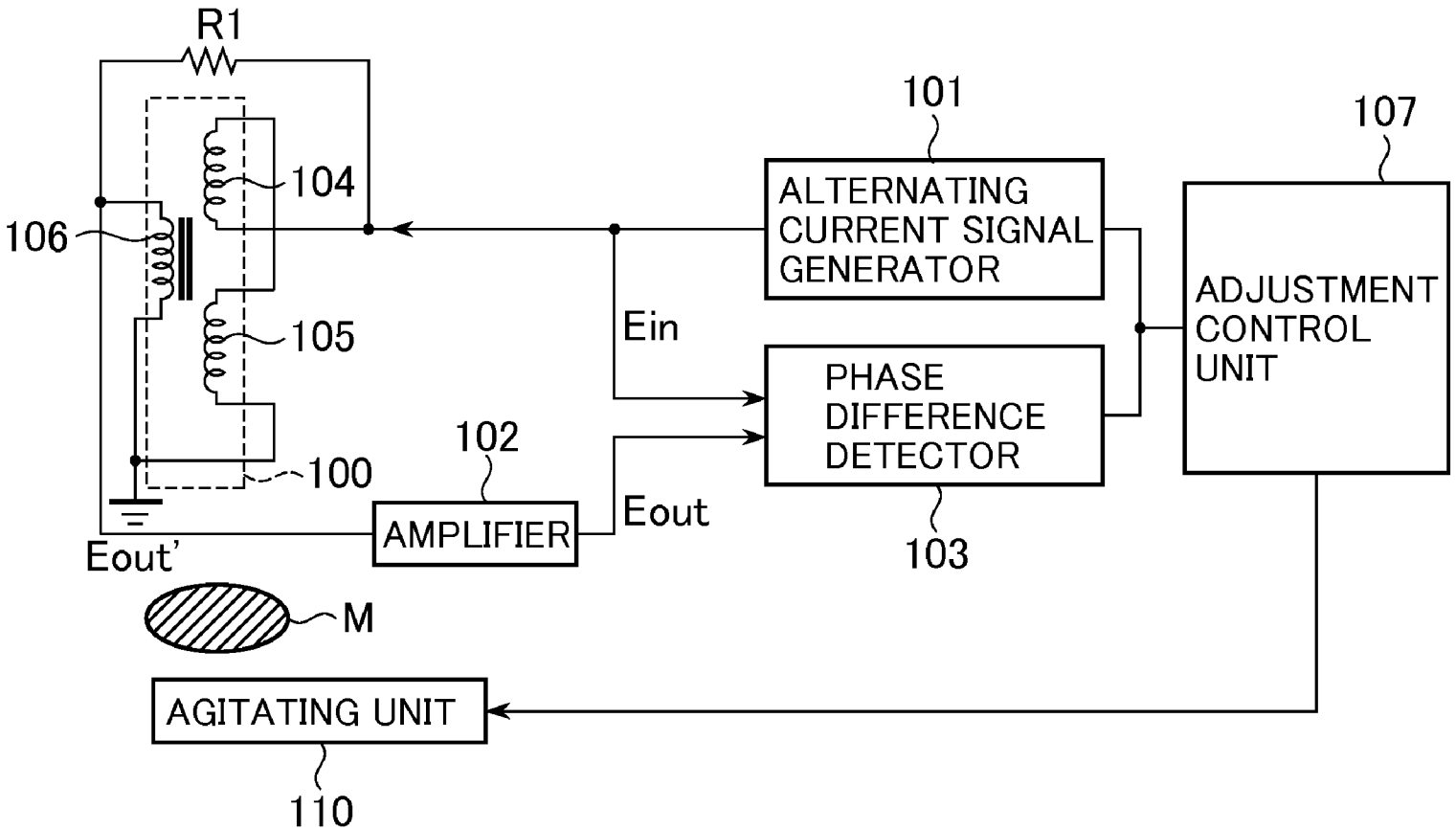
FIG. 1 is a schematic diagram of a magnetic material detecting device according to an embodiment of the present invention.

FIG. 1 is a schematic diagram of a magnetic material detecting device according to an embodiment of the present invention. The magnetic material detecting device has a differential transformer (a transformer unit) 100, an alternating current signal generator (an alternating current signal generating unit) 101, an amplifier 102, a phase difference detector (a phase difference detecting unit) 103, an adjustment control unit (a control unit) 107, and an agitating unit 110.

As shown in FIG. 1, the differential transformer 100 has differentially connected drive coils 104 and 105, and an output coil 106 differentially connected to the drive coils 104 and 105.

The alternating current signal generator 101 supplies an input signal (an alternating current signal) Ein with predetermined electrical characteristics to the drive coils 104 and 105 to drive the drive coils 104 and 105. The input signal Ein from the alternating current signal generator 101 is also supplied to the output coil 106 via a resistance R1 to stabilize an output signal Eout' outputted at the output coil 106. The output signal Eout' is a detection signal of magnetic material M, and outputted from the output coil 106 depending on a magnetic material environment of the magnetic material M. The magnetic material environment refers to an environment in which the magnetic material M is placed, which will be described later on.

The amplifier 102 amplifies the output signal Eout' outputted from the output coil 106, and outputs an amplified output signal Eout. The output signals Eout' and Eout has the same phase. The phase difference detector 103 receives the input signal Ein supplied to the drive coils 104 and 105 and the output signal Eout outputted from the output coil 106 via the amplifier 102, and then detects a phase difference between these signals therein. The phase difference detector 103 has a storage unit (not shown) to temporarily store a detected phase difference data.

The magnetic material M to be detected is placed so as to be opposed to the drive coil 105. A magnitude relation between one magnetic material binding force of the drive coil 104 and the output coil 106 and the other magnetic material binding force of the drive coil 105 and the output coil 106 changes depending on the concentration of the magnetic material M, and then the change appears as a change in phase of the output signal Eout' from the output coil 106.

Therefore, the phase difference between the input signal Ein supplied to the drive coils 104 and 105 and the output signal Eout outputted from the output coil 106 via the amplifier 102 allows the concentration of the magnetic material M to be detected.

The adjustment control unit 107 detects the concentration of the magnetic material M from the input signal Ein generated by the alternating current signal generator 101 and the phase difference data detected by the phase difference detector 103. The adjustment control unit 107 controls the agitating unit 110 configured to cause the magnetic material M to be flowed.

The agitating unit 110 can be switched between a rotating state and a stopped state by the adjustment control unit 107, and serves to cause the magnetic material M to be flowed in the rotating state to carry the magnetic material M in a predetermined direction. It is noted that the magnetic material environment, thus, means an environment in which the magnetic material M is carried in a predetermined direction while flowing in the rotating state of the agitating unit 110, and substantially come to a standstill in a predetermined position in the stopped state of the agitating unit 110, herein.

Flow of the magnetic material M caused by the agitating unit 110 produces unevenness (condensation and rarefaction) in the density distribution of the magnetic material M. Therefore, in a state where the magnetic material M is flowing, fluctuations in detection values occur depending on a timing of detecting the concentration of the magnetic material M even when the distribution of the concentration of the magnetic material M is nearly uniform.

The timing of detecting the concentration of the magnetic material M means a timing of detecting a phase difference between the input signal Ein supplied to the drive coils 104 and 105 and the output signal Eout outputted from the output coil 106 via the amplifier 102 and obtaining detected phase difference data.

Thus, in the embodiment, in order to correctly detect the concentration of the magnetic material M, a period in which the agitating unit 110 rotates about one revolution is set as a minimum unit of period to obtain phase difference data. Moreover, detections of a phase difference between the input signal Ein and the output signal Eout are implemented more than once during the minimum unit of sampling period. Thus, a plurality of phase difference data can be obtained during the minimum unit of sampling period to detect the concentration of the magnetic material M from a plurality of obtained phase difference data.

A method for detecting the concentration of the magnetic material M will be specifically described later on with reference to FIG. 3.

Figure 2:
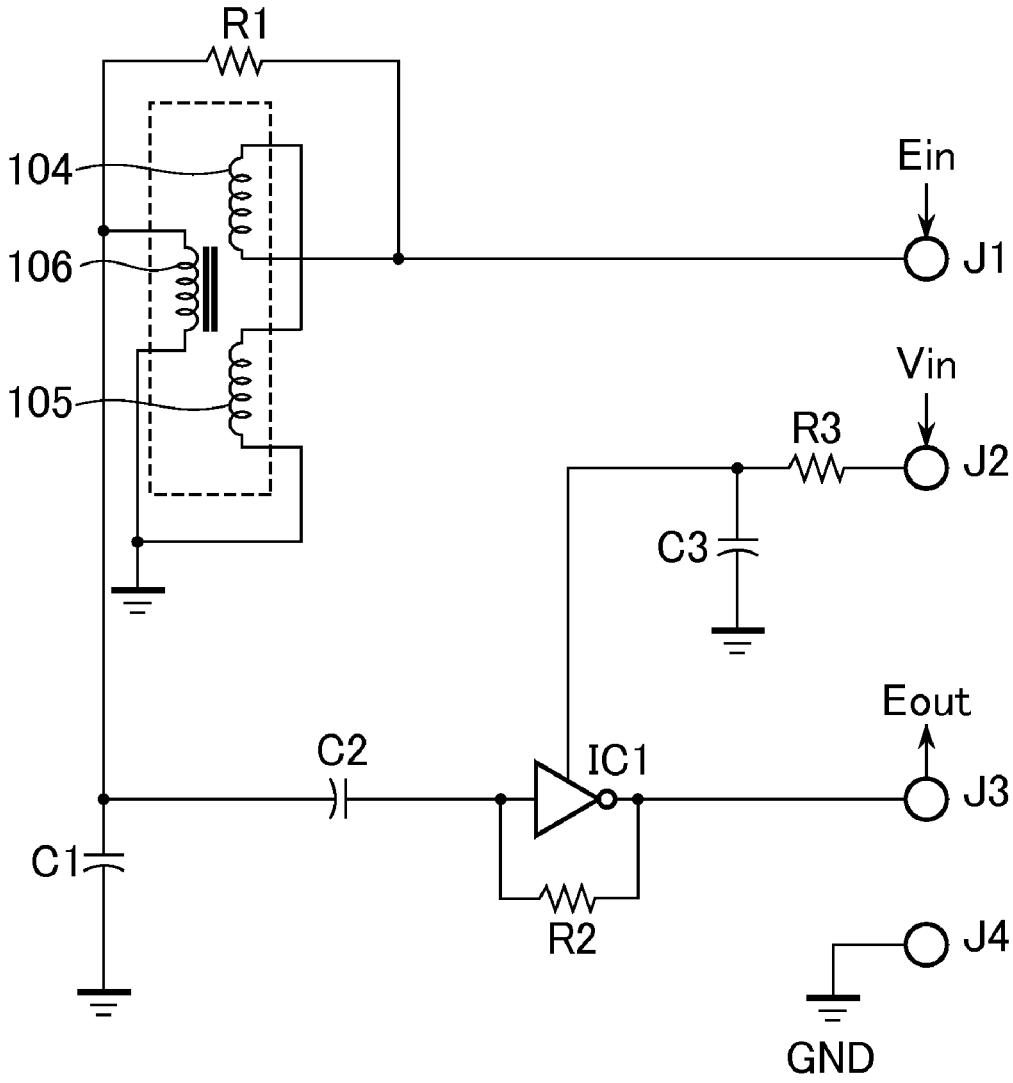
FIG. 2 is a view showing a specific example of an electrical diagram of the magnetic material detecting device of FIG. 1.

FIG. 2 is a view showing a specific example of an electrical diagram of the magnetic material detecting device of FIG. 1.

The example shown in FIG. 2 is not intended to limit the present invention. Duplicate descriptions of elements designated by the same reference characters as shown in FIG. 1 will be omitted.

As shown in FIG. 2, the magnetic material detecting device includes connectors J1 to J4. The magnetic material detecting device is connected to predetermined equipment or the like via the connectors J1 to J4 as described below.

The connector J1 receives an input signal Ein from the alternating current signal generator 101 shown in FIG. 1.

The connector J2 receives a power supply voltage Vin. The power supply voltage Vin, after passing through a filter circuit composed of a resistance R3 and a capacitor C3, is used as a power supply voltage for an inverter IC1 which is equivalent to the amplifier 102 shown in FIG. 1. Reference character R2 is an amplification feedback resister of the inverter IC1.

An output signal Eout is outputted from the connector J3. The output signal Eout is a signal that is outputted from the output coil 106, tuned in a tuning circuit composed of the output coil 106 and a capacitor C1, and then amplified by a coupling capacitor C2, the inverter IC1, and the amplification feedback resister R2. The connector J4 is connected to GND.

Figure 3:
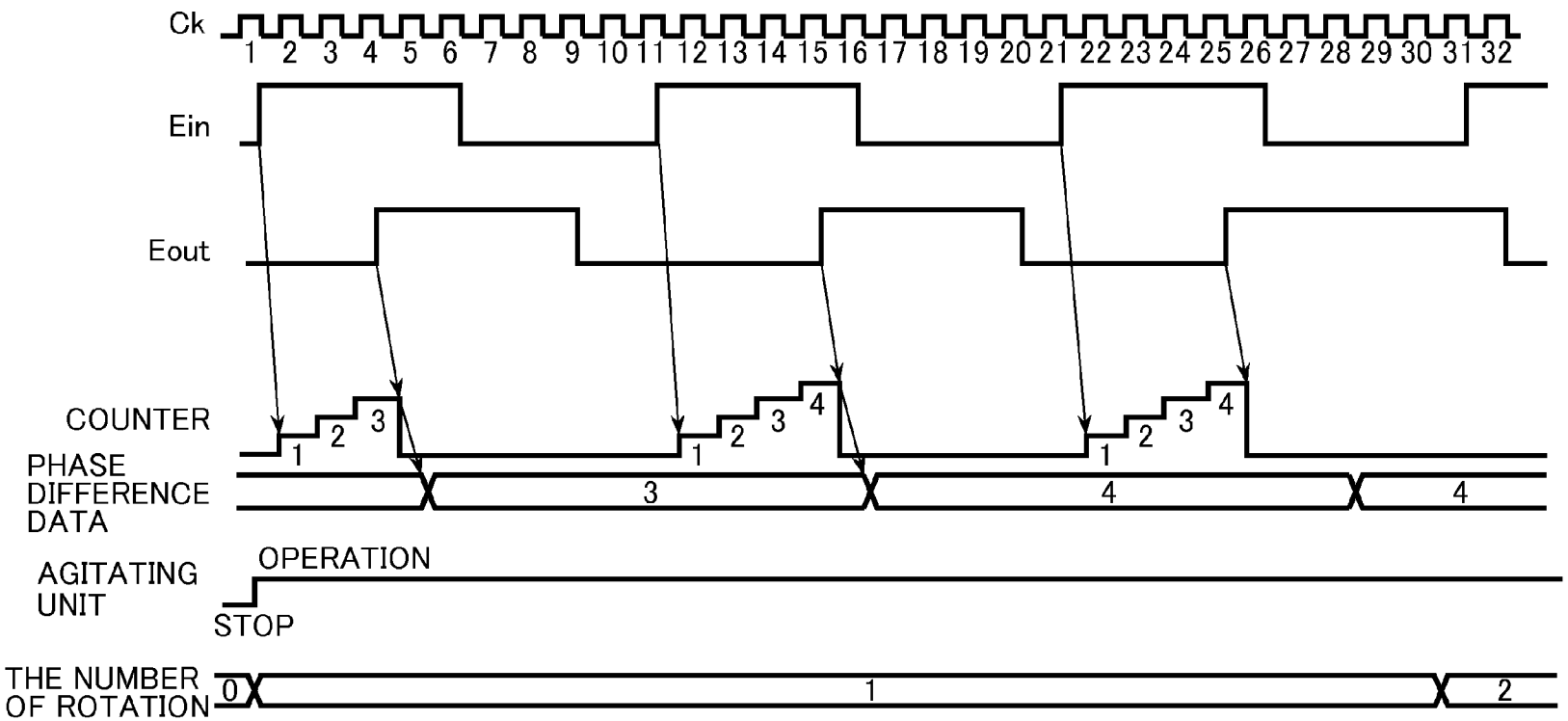
FIG. 3 is a timing chart showing a detection timing of phase difference data in a phase difference detector of FIG. 1.

A method for detecting the concentration of magnetic material M will be now described in detail in conjunction with FIG. 3.

FIG. 3 is a timing chart showing a detection timing of phase difference data in the phase difference detector, which shows change in various parameters (Ck, Ein, Eout, action of a counter, phase difference data, stopped and operating states of the agitating unit, the number of rotation of the agitating unit) in association with detection of the phase difference data when the phase difference data of the magnetic material with a nearly uniform concentration is detected.

In FIG. 3, the horizontal axis indicates elapsed time (arbitrary unit). A first row in FIG. 3 indicates a basic clock Ck for operation of the phase difference detector 103, and a second row indicates an input signal Ein supplied to the drive coils 104 and 105 to drive the drive coils 104 and 105.

A third row in FIG. 3 indicates an output signal Eout outputted from the output coil 106 via the amplifier 102. As mentioned previously, the output signal Eout has a phase difference depending on the concentration of magnetic material M relative to the input signal Ein.

A fourth row in FIG. 3 indicates operation of phase difference detection by the phase difference detector 103. In the phase difference detector 103, its counter starts counting up based on the basic clock Ck when a rising edge of the input signal Ein is entered, and stops counting up when a rising edge of the output signal Eout is entered. The phase difference detector 103 temporarily stores count values as phase difference data in a storage unit with which the detector 103 is provided therein.

A fifth row in FIG. 3 indicates stopped and operating states of the agitating unit 110, and a sixth row indicates the number of rotation of the agitating unit 110.

As mentioned previously, in the operating state of the agitating unit 110, unevenness in density of the magnetic material M leads to change in the phase difference between the input signal Ein and the output signal Eout even when the concentration of the magnetic material M is nearly uniform.

For example, with the agitating unit 110 having a screw-shaped configuration, the density of the magnetic material M is changed to condensation or rarefaction state depending on a rotation cycle of screw, and the phase difference between the input signal Ein and the output signal Eout is changed depending on the magnitude of the density.

Then, for example, a period in which the agitating unit 110 rotates about one revolution (a period in which the number of rotation (sixth row) indicates "1" in FIG. 3) is set as the minimum unit of sampling period to obtain the phase difference data between the input signal Ein and the output signal Eout by the adjustment control unit 107. Moreover, during this minimum unit of sampling period, the phase difference detector 103 implements detection of the phase difference between the input signal Ein and the output signal Eout more than once. The adjustment control unit 107, thus, can obtain a plurality of phase difference data during the minimum unit of sampling period.

In the embodiment, as shown in FIG. 3, during the period in which the agitating unit 110 rotates about one revolution, the phase difference detector 103 detects the phase difference three times, and obtains these phase difference data. An average of a plurality of phase difference data obtained in this way is calculated by the adjustment control unit 107. The average allows the concentration of the magnetic material M to be detected.

The method for detecting the concentration of the magnetic material M from a plurality of phase difference data is not limited to calculating average thereof as above. For example, the concentration of the magnetic material M may be detected from an integrated value of a plurality of phase difference data.

Moreover, in the case the minimum unit of sampling period to obtain phase difference data is shorter than the period in which the agitating unit 110 rotates about one revolution, it increases the impossibility of canceling the change in density of the magnetic material M varied periodically by rotation of the agitating unit 110, and therefore it is not acceptable.

Further, in order to cancel the change in density of the magnetic material M varied periodically by rotation of the agitating unit 110, a sampling period of phase difference data (a total sampling period) may be a period in which the agitating unit 110 rotates about more than once.

The sampling period of phase difference data to identify the concentration of the magnetic material M may be set in accordance with an actually changing speed of the concentration of the magnetic material M and a rotation speed of the agitating unit 110. For example, setting of an extremely long total sampling period causes a delay of detection response in the case the concentration of the magnetic material M varies actually, and thus it is not acceptable.

Figure 4:
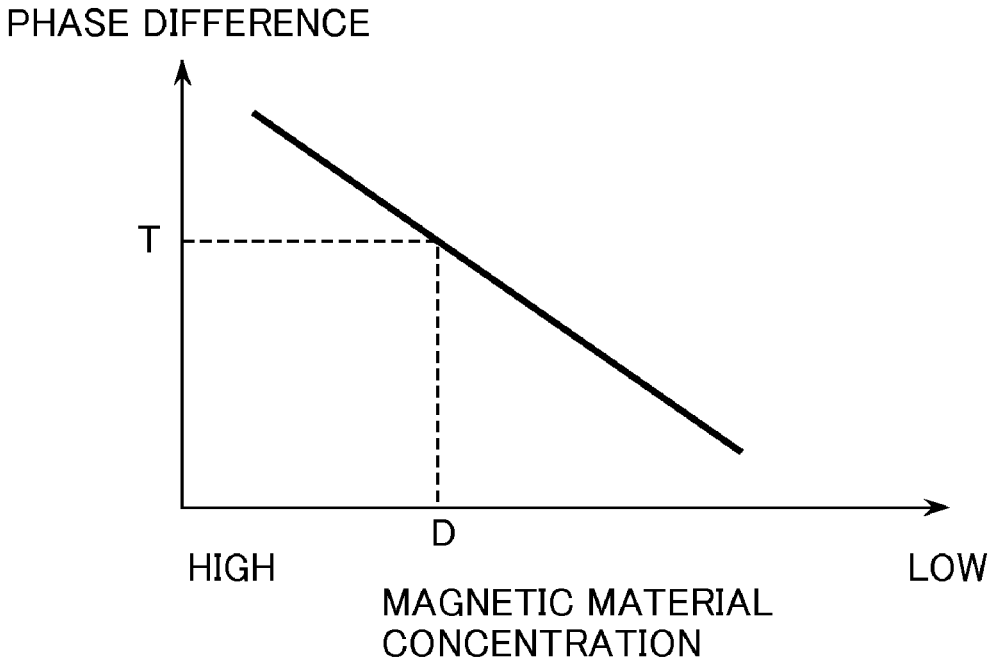
FIG. 4 is a characteristic graph of a phase difference to a magnetic material concentration, the graph being detected by the phase difference detector of FIG. 1.

FIG. 4 is a characteristic graph of a phase difference data to a magnetic material concentration (the concentration of magnetic material M), which is detected by the phase difference detector illustrated in FIG. 1.

In FIG. 4, the vertical axis indicates a phase difference detected by the phase difference detector 103, and the horizontal axis indicates a magnetic material concentration.

As shown in FIG. 4, a small value of the phase difference indicates low magnetic material concentration, while a large value of the phase difference indicates high magnetic material concentration.

Such a relation between the magnetic material concentration and the phase difference prepared in the adjustment control unit 107 in advance allows a magnetic material concentration to be identified from phase difference data obtained in an actual sampling. In FIG. 4, for example, when a phase difference calculated as above is T, it can be identified that a magnetic material concentration is D.

Figure 5:
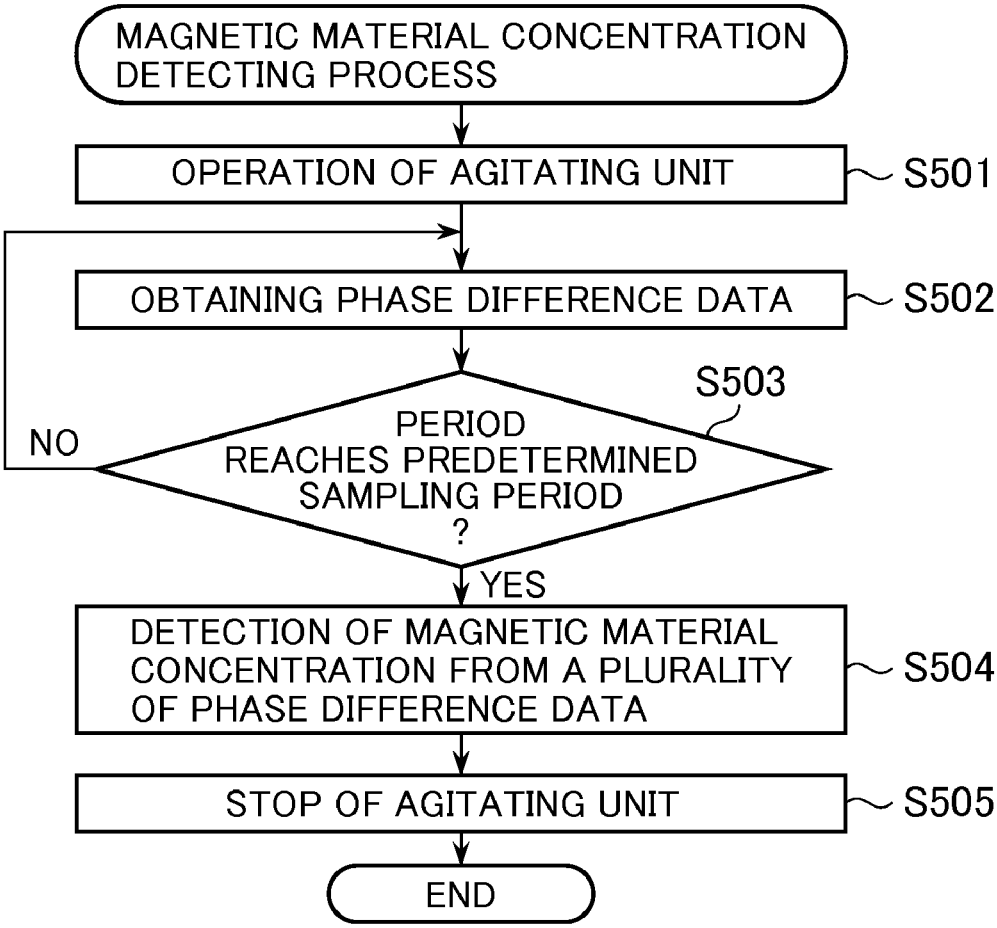
FIG. 5 is a flow chart showing a procedure of magnetic material detecting process implemented by the magnetic material detecting device of FIG. 1.
Figure 6:
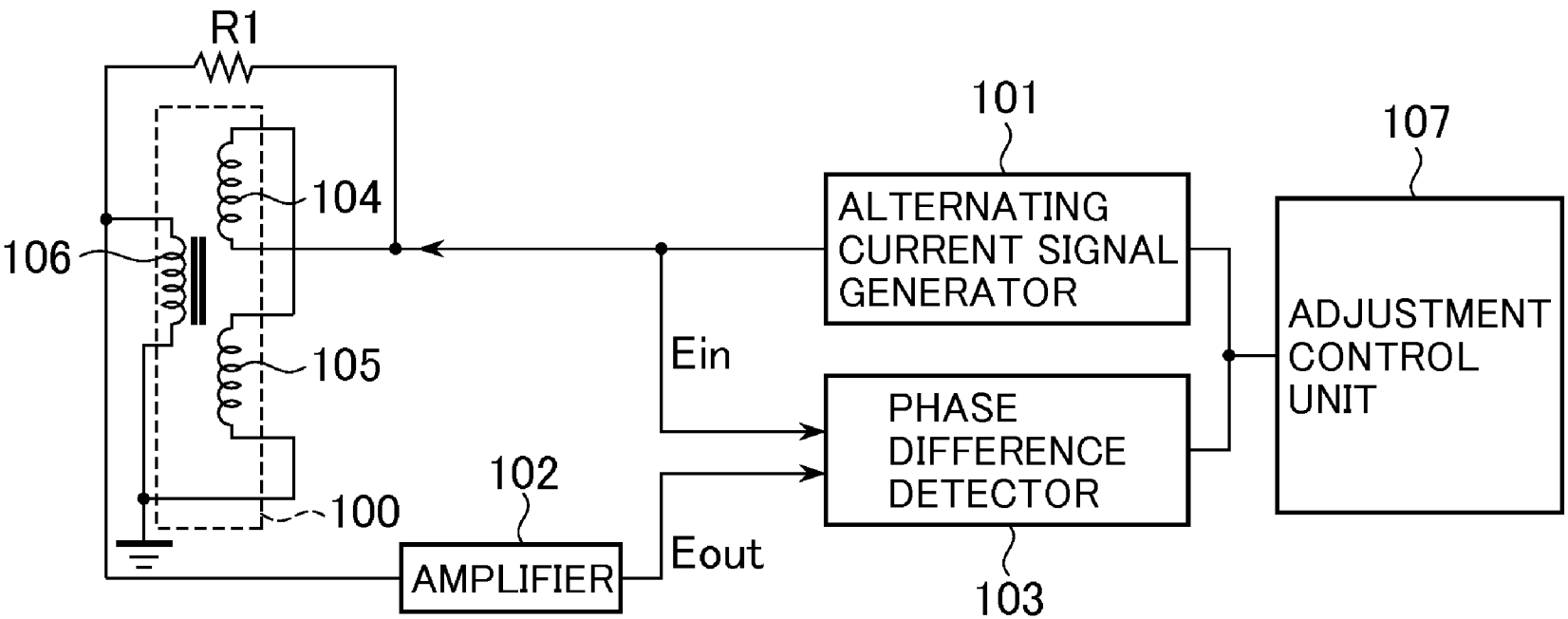
FIG. 6 is a schematic diagram of a magnetic material detecting device according to a prior art.

A procedure of detecting a magnetic material concentration will be now described based on a controlling flow chart shown in FIG. 5.

FIG. 5 is a flow chart showing a procedure of magnetic material detecting process implemented by the magnetic material detecting device of FIG. 1.

At the beginning, the adjustment control unit 107 operates the agitating unit 110 (step S501).

Subsequently, the adjustment control unit 107 obtains phase difference data between an input signal Ein and an output signal Eout that is detected and retained in the phase difference detector 103 (step S502).

Then, whether or not period for obtaining the phase difference data reaches a predetermined sampling period is determined (step S503). It is noted that the predetermined sampling period is the aforementioned total sampling period. With a period in which the agitating unit 110 rotates about one revolution being set as the minimum unit of sampling period, a predetermined sampling period may be set to a period in which the agitating unit 110 rotates about more than once. Moreover, a plurality of phase difference data may be designed to be obtained during the minimum unit of sampling period.

If a determination at step S503 is "NO", the adjustment control unit 107 implements obtaining phase difference data until a predetermined sampling period is reached. The determination at step S503 turns to "YES", so that obtaining the phase difference data is ended, and a magnetic material concentration is detected by the obtained phase difference data using the relation of the phase difference data to a magnetic material concentration provided in the adjustment control unit 107 in advance (step S504).

Then, the adjustment control unit 107 stops the agitating unit 110 (step S505). Thus, the magnetic material concentration detecting process is ended.

The adjustment control unit 107 controls the magnetic material concentration so as to keep it constant based on the relation of the phase difference data and the magnetic material concentration shown in FIG. 4.

Specifically, in the case that the magnetic material is a magnetic carrier contained in a developer, and when its magnetic material concentration is high, a non-magnetic material (a non-magnetic toner) is supplied to its magnetic material environment to reduce the magnetic material concentration so as to keep it at a predetermined value. On the other hand, when the non-magnetic material concentration is high, supply of the non-magnetic material to the magnetic material environment is stopped.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2008-36035 filed Feb. 18, 2008, which is hereby incorporated by reference herein in its entirety.

What is claimed is:

1. A magnetic material detecting device comprising:

a magnetic field generating device that is arranged in a two-component developer composed of magnetic carrier and non-magnetic toner, said magnetic field generating device adapted to generate a magnetic field;

a signal output device that is arranged in the two-component developer, said signal output device adapted to output a signal depending on a magnetic permeability of the two-component developer due to the magnetic field generated by said magnetic field generating device;

an agitating unit adapted to agitate the two-component developer and make the two-component developer flow between said magnetic field generating device and said signal output device; and a detecting unit adapted to detect a proportion of the non-magnetic toner in the two-component developer based on a result of multiple times sampling of the signal outputted from said signal output device after said agitating unit starts to operate;

wherein said magnetic field generating device is a drive coil driven by an alternating current signal;

wherein said signal output device is an output coil differentially connected to the drive coil; and wherein a transformer unit is composed of the drive coil and the output coil.

2. The magnetic material detecting device according to claim 1, wherein said detecting unit detects the proportion of the non-magnetic toner in the two-component developer based on a phase difference between the alternating current signal to drive the drive coil and a output signal outputted from the output coil.

3. The magnetic material detecting device according to claim 2, wherein a period in which said agitating unit rotates one revolution is set as a minimum unit of sampling period to detect the phase difference; and wherein said detecting unit detects the proportion of the non-magnetic toner in the two-component developer based on a plurality of the phase difference detected during the minimum unit of sampling period.

4. The magnetic material detecting device according to claim 3, wherein a period in which the agitating unit rotates more than once is set as a predetermined sampling period; and wherein said detecting unit detects the proportion of the non-magnetic toner in the two-component developer based on a plurality of the phase difference detected during the predetermined sampling period.

* * * * *